US010593258B2

(12) United States Patent
Jung

(10) Patent No.: US 10,593,258 B2
(45) Date of Patent: Mar. 17, 2020

(54) ORGANIC LIGHT EMITTING DISPLAY DEVICE INCLUDING EM DRIVER WITH SIMPLIFIED STRUCTURE AND FOR DRIVING THE SAME

(71) Applicant: LG Display Co., Ltd., Seoul (KR)

(72) Inventor: DaeSung Jung, Paju (KR)

(73) Assignee: LG Display Co., Ltd., Seoul (KR)

( * ) Notice: Subject to any disclaimer, the term of this patent is extended or adjusted under 35 U.S.C. 154(b) by 184 days.

(21) Appl. No.: 15/725,514

(22) Filed: Oct. 5, 2017

(65) Prior Publication Data

US 2018/0114482 A1 Apr. 26, 2018

(30) Foreign Application Priority Data

Oct. 25, 2016 (KR) ..... 10-2016-0139533

(51) Int. Cl.

| | |
|---|---|
| ***G09G 3/3225*** | (2016.01) |
| ***G09G 3/20*** | (2006.01) |
| ***G09G 3/325*** | (2016.01) |
| ***G09G 3/3266*** | (2016.01) |
| ***G09G 3/3275*** | (2016.01) |

(52) U.S. Cl.

CPC ..... *G09G 3/3225* (2013.01); *G09G 3/2014* (2013.01); *G09G 3/325* (2013.01); *G09G 3/3266* (2013.01); *G09G 3/3275* (2013.01); *G09G 2300/0861* (2013.01); *G09G 2310/0267* (2013.01); *G09G 2310/08* (2013.01)

(58) Field of Classification Search

None

See application file for complete search history.

(56) References Cited

U.S. PATENT DOCUMENTS

| | | | |
|---|---|---|---|
| 2005/0116903 | A1 | 6/2005 | Shin |
| 2013/0222352 | A1 | 8/2013 | Jeong |
| 2016/0133184 | A1 | 5/2016 | Gupta et al. |
| 2016/0275845 | A1 | 9/2016 | Tsai et al. |

FOREIGN PATENT DOCUMENTS

| | | | |
|---|---|---|---|
| JP | 2005308857 | A | 11/2005 |
| JP | 2006-285236 | A | 10/2006 |
| JP | 2007310158 | A | 11/2007 |
| JP | 2007316163 | A | 12/2007 |
| JP | 2009258397 | A | 11/2009 |
| JP | 2014041337 | A | 3/2014 |

OTHER PUBLICATIONS

Office Action dated Sep. 4, 2018 issued in the correspondence Japanese Patent Application No. 2017-204217, pp. 1-4.

Extended European Search Report issued in European Patent Application No. 17190796.7 dated Feb. 21, 2018.

*Primary Examiner* — Gustavo Polo

(74) *Attorney, Agent, or Firm* — Polsinelli PC

(57) ABSTRACT

The present disclosure relates to an organic light emitting display device and a device for driving the same. The present provides the organic light emitting display device that enables implementation of a narrow bezel and easy implementation of a circuit by simplifying a structure of an EM driver, and a device for driving the same.

23 Claims, 10 Drawing Sheets

ORGANIC LIGHT EMITTING DISPLAY DEVICE INCLUDING EM DRIVER WITH SIMPLIFIED STRUCTURE AND FOR DRIVING THE SAME

CROSS-REFERENCE TO RELATED APPLICATION

This application claims priority from Korean Patent Application No. 10-2016-0139533, filed on Oct. 25, 2016, which is hereby incorporated by reference in its entirety for all purposes as if fully set forth herein.

BACKGROUND

Field of the Disclosure

The present disclosure relates to a display device, and more particularly, to an organic light emitting display device and a device for driving the same. Although the present disclosure has a wide scope of application, it is particularly suitable for implementing a narrow bezel and simplifying a driving circuit structure of the organic light emitting display device and, and the device for driving the same.

Description of the Background

An active matrix organic light emitting display device includes a self-emitting organic light emitting diode (hereinafter, referred to as "OLED") and thus has the advantages of a high response speed and increased luminous efficiency, brightness and view angle. The OLED includes an organic compound layer formed between an anode and a cathode. The organic compound layer includes a hole injection layer (HIL), a hole transport layer (HTL), an emission layer (EML), an electron transport layer (ETL), and an electron injection layer (EIL). When a driving voltage is applied to the anode and the cathode of the OLED, a hole passing through the hole transport layer (HTL) and an electron passing through the electron transport layer (ETL) move to the emission layer (EML) and form an exciton. As a result, the emission layer (EML) generates a visible light.

The organic light emitting display device may be driven by a duty driving method. In order to implement the duty driving method, an emission control signal (hereinafter, referred to as "EM signal") needs to be applied to sub-pixels. The EM signal is generated as an alternating current (AC) signal swung between an ON level that defines a time of turning on the sub-pixels and an OFF level that defines a time of turning off the sub-pixels, and the times of turning on and turning off the sub-pixels are defined as a duty ratio of the EM signal. As for a p-type metal oxide semiconductor field effect transistor (MOSFET), the ON level is a low logic level and the OFF level is a high logic level.

In order to implement the duty driving method, an EM driver capable of switching from ON level to OFF level or vice versa at any time is needed. The EM driver includes a shift register that sequentially generates scan signals and an inverter that inverts the output of the shift register.

The EM driver may be formed in the bezel area, and the bezel area is a non-display area disposed at an edge of the display panel. In the conventional organic light emitting display device, the shift register and the inverter constitute the EM driver. Thus, a circuit area of the EM driver is relatively large. Therefore, the bezel area of the display panel is increased, which makes it difficult to achieve a narrow bezel. Also, a layout space for circuit is decreased, which makes it difficult to implement a circuit.

SUMMARY

An aspect of the present disclosure provides an organic light emitting display device that enables implementation of a narrow bezel and easy implementation of a circuit by simplifying a structure of an EM driver, and a device for driving the same.

According to an aspect of the present disclosure, there is provided a display panel in which pixels are disposed in a matrix form. There is provided a data driver that supplies a data voltage to the display panel. There is provided a scan driver that supplies a scan signal to be synchronized with the data voltage. There is provided a timing controller that generates a timing control signal for controlling an operation timing of the data driver and an operation timing of the scan driver. There is provided an organic light emitting display device including a duty driver that generates an EM signal for controlling on and off of pixels in response to the timing control signal from the timing controller, and operates the EM signal at a high voltage level in response to a high signal of a start pulse for controlling output generation and operates the EM signal at a low voltage level in response to a low signal of the start pulse to regulate a cycle and a width of the EM signal.

According to another aspect of the present disclosure, there is provided a device for driving an organic light emitting display device including pixels which are turned on and off during a duty driving period in response to an EM signal. There is provided the device for driving the organic light emitting display device including a duty driver that generates an EM signal for controlling on and off of the pixels, and operates the EM signal at a high voltage level in response to a high signal of a start pulse for controlling output generation and operates the EM signal at a low voltage level in response to a low signal of the start pulse to regulate a cycle and a width of the EM signal.

According to a further aspect of the present disclosure, there is provided an apparatus for driving an organic light emitting display device comprising a plurality of pixels operating during a duty driving period in response to an EM signal, the apparatus includes a duty driver receiving a start pulse of an off-level voltage and a shift clock of an on-level voltage, and outputting the EM signal and shifting the EM signal at a shift clock timing in operating the plurality of pixels, wherein the duty driver operates the EM signal at an off level when the start pulse is input, and a width of the EM signal is determined by a width of the start pulse.

According to the present exemplary aspects described above, it is possible to regulate a cycle, a pulse width, and a duty ratio of an EM signal using an EM driver having a single circuit structure and thus possible to simplify a circuit. Therefore, the size of a bezel area where the EM driver is disposed can be reduced and the implementation of circuit can be facilitated.

Further, according to the present exemplary aspects, a duty ratio can be regulated by the EM driver. Thus, it becomes easy to regulate a gray scale and it is possible to improve Mura of a display panel. Also, it is advantageous for optical compensation and possible to improve flickers and motion blur.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
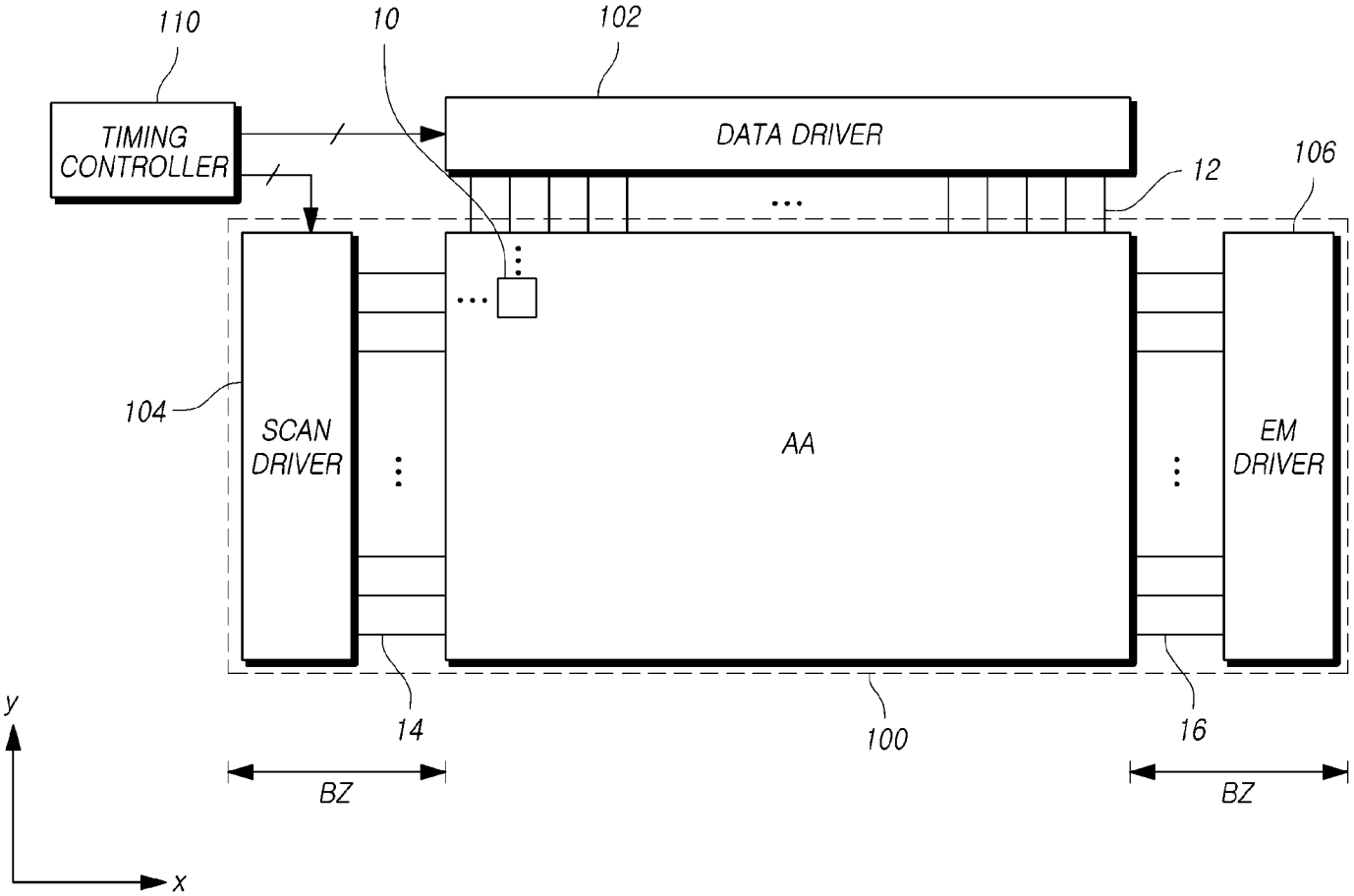
FIG. 1 is a block diagram illustrating an organic light emitting display device according to an exemplary aspect of the present disclosure.

Hereinafter, exemplary aspects of the present disclosure will be described in detail with reference to the accompanying drawings. The exemplary aspects introduced hereinafter are provided as examples in order to convey their spirits to a person having ordinary skill in the art. Therefore, the present disclosure is not limited to the following exemplary aspects and can be embodied in a different form. Also, the size and thickness of the device may be expressed to be exaggerated for the sake of convenience in the drawings. Like reference numerals generally denote like elements throughout the present specification.

Advantages and features of the present disclosure, and methods for accomplishing the same will be more clearly understood from exemplary aspects described below with reference to the accompanying drawings. However, the present disclosure is not limited to the following exemplary aspects but may be implemented in various different forms. The exemplary aspects are provided only to complete disclosure of the present disclosure and to fully provide a person having ordinary skill in the art to which the present disclosure pertains with the category of the disclosure, and the present disclosure will be defined by the appended claims. Like reference numerals generally denote like elements throughout the present specification. In the drawings, the sizes and relative sizes of layers and regions may be exaggerated for clarity.

When an element or layer is referred to as being "on" another element or layer, it may be directly on the other element or layer, or intervening elements or layers may be present. Meanwhile, when an element is referred to as being "directly on" another element, any intervening elements may not be present.

The spatially-relative terms such as "below", "beneath", "lower", "above", "upper", etc. may be used herein for ease of description to describe the relationship of one element or components with another element(s) or component(s) as illustrated in the drawings. It will be understood that the spatially relative terms are intended to encompass different orientations of the element in use or operation, in addition to the orientation depicted in the drawings. For example, if the element in the drawings is turned over, elements described as "below" or "beneath" other elements would then be oriented "above" the other elements. Thus, the exemplary term "below" can encompass both an orientation of above and below.

Further, in describing components of the present disclosure, terms such as first, second, A, B, (a), (b), etc. can be used. These terms are used only to differentiate the components from other components. Therefore, the nature, order, sequence, or number of the corresponding components is not limited by these terms.

FIG. 1 is a block diagram illustrating an organic light emitting display device according to an exemplary aspect of the present disclosure.

Referring to FIG. 1, an organic light emitting display device according to an exemplary aspect of the present disclosure includes a display panel 100, a data driver 102, a scan driver 104, an EM driver 106, and a timing controller 110.

The data driver 102 generates a data voltage DATA by converting data of an input image received from the timing controller 110 into a gamma compensation voltage under the control of the timing controller 110, and outputs the data voltage DATA to data lines 12. The data voltage DATA is supplied to pixels 10 through the data lines 12.

The scan driver 104 sequentially supplies a scan signal SCAN to scan lines 12 using a shift register under the control of the timing controller 110. The scan signal SCAN is synchronized with the data voltage DATA. The shift register of the scan driver 104 may be formed directly on a substrate of the display panel 100 together with a pixel array AA in a gate-driver in panel (GIP) process.

The EM driver 106 may be referred to as an emission driver or duty driver that implements a duty driving method by sequentially supplying an EM signal EM to EM lines 16 under the control of the timing controller 110. The EM driver 106 may be formed directly on the substrate of the display panel 100 together with the pixel array AA in the GIP process.

The EM driver 106 receives a start pulse VST of an off-level voltage and a shift clock of an on-level voltage and outputs the EM signal EM and shifts the EM signal EM at a shift clock timing. The shift clock includes clocks CLK1 to CLK2 which are phase-shifted sequentially. The EM driver 106 operates the EM signal at an off level whenever the start pulse is input, and the width of the EM signal is determined to be in association with the width of the start pulse.

Although the EM driver 106 is illustrated as a single block in FIG. 1, the EM driver 106 may be provided in each of pixel lines. Each EM driver 106 receives a start pulse and a shift clock. The start pulse is toggled one or more times within an emission period (i.e. a duty driving period) during every frame period, to invert the EM signal EM. Herein, the EM signal may also be referred to as an emission control signal.

The timing controller 110 controls operation timings of the data driver 102, the scan driver 104, and the EM driver 106 to synchronize operations of these drivers 102, 104, and 106. The timing controller 110 receives digital video data of an input image and a timing signal to be synchronized with the digital video data from a non-illustrated host system. The timing signal includes a vertical synchronization signal Vsync, a horizontal synchronization signal Hsync, a clock signal CLK, and a data enable signal DE. The host system may be one of a television (TV) system, a set-top box, a navigation system, a DVD player, a Blu-ray player, a personal computer (PC), a home theater system, and a phone system.

The timing controller 110 generates a data timing control signal for controlling an operation timing of the data driver 102, a scan timing control signal for controlling an operation timing of the scan driver 104, and an EM timing control signal for controlling an operation timing of the EM driver 106 on the basis of the timing signal received from the host system.

Each of the scan timing control signal and the EM timing control signal includes a start pulse, a shift clock, etc. The start pulse VST defines a start timing for each of the scan driver 104 and the EM driver 106 to generate a first output. The EM driver 106 starts driving when the start pulse VST is input and generates a first output signal at a first clock timing. The shift clock defines a shift timing for an output signal to be output from the EM driver 106.

The display panel 110 includes a pixel array AA where an input image is displayed and a bezel area BZ outside the pixel array AA. The pixel array AA includes a plurality of data lines 12, a plurality of scan lines 14, and a plurality of EM lines 16. The scan lines 14 and the EM lines 16 perpendicularly intersect with the data lines 12. Pixels 10 in the pixel array AA are disposed in a matrix form.

Meanwhile, in the organic light emitting display device according to the present exemplary aspects, each sub-pixel includes an organic light emitting diode OLED and circuit elements such as a driving transistor DRT for driving the organic light emitting diode OLED. The kind and the number of circuit elements constituting each sub-pixel may be determined in various ways depending on a provided function and a design method.

Figure 2:
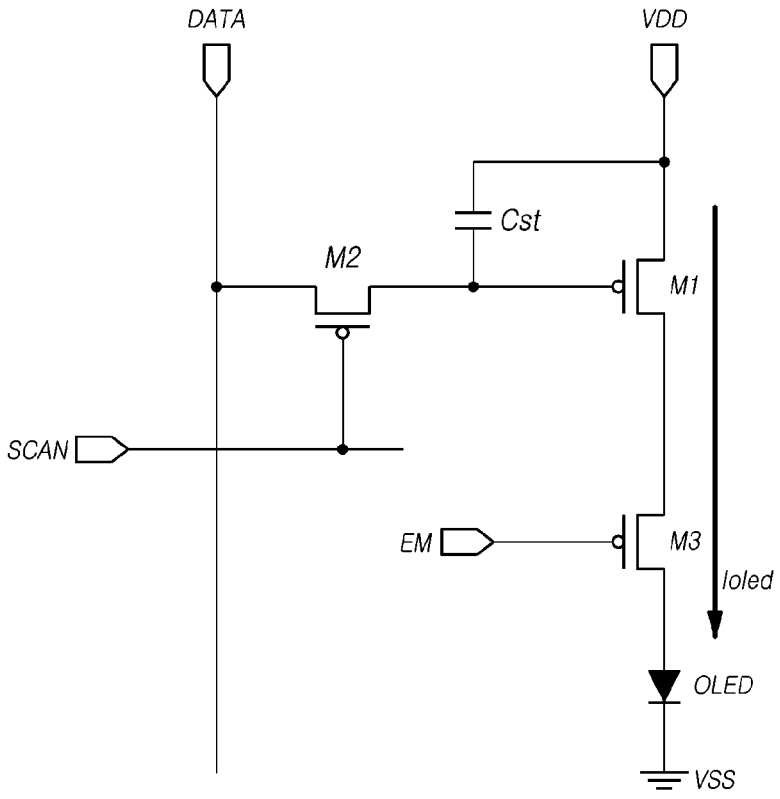
FIG. 2 is a circuit diagram of a sub-pixel according to an exemplary aspect of the present disclosure.

To display colors, each of the pixels may be divided into a red sub-pixel, a green sub-pixel, and a blue sub-pixel. Each of the pixels may further include a white sub-pixel. Each of the sub-pixels includes an OLED, a driving thin film transistor TFT M1, a first switch TFT M2, a second switch TFT M3, and a storage capacitor Cst as illustrated in FIG. 2. The TFTs M1, M2, and M3 are illustrated as p-type MOSFETs in FIG. 2, but are not limited thereto. For example, the TFTs M1, M2, and M3 may be implemented as n-type MOSFETs. In this case, the phases of the scan signal SCAN and the emission control signal (hereinafter, referred to as "EM signal") EM are inverted. The TFTs M1, M2, and M3 may be implemented as one of an amorphous silicon (a-Si) TFT, a polysilicon TFT, and an oxide semiconductor TFT or as a combination thereof.

An anode of the OLED is connected to the driving TFT M1 through the second switch TFT M3. A cathode of the OLED is connected to a VSS electrode so as to be supplied with a base voltage VSS. The base voltage may be a negative low potential direct current voltage.

The driving TFT M1 is a driving element that regulates a current holed flowing in the OLED according to a gate-source voltage. The driving TFT M1 includes a gate to be supplied with a data voltage through the first switch TFT M2, a source to be supplied with a high potential driving voltage VDD supplied to a VDD line, and a drain connected to the second switch TFT M3. The storage capacitor Cst is connected between the gate and the source of the driving TFT M1.

The first switch TFT M2 is a switch element that is turned on in response to a scan signal SCAN from the scan line 14 during a scan period so as to supply a data voltage DATA to the gate of the driving TFT M1 and maintains an off state during a duty driving period, (i.e. an emission period). The first switch TFT M2 includes a gate connected to the scan line 14, a source connected to the data line 12, and a drain connected to the gate of the driving TFT M1. The scan signal SCAN is supplied to the pixels through the scan lines 14 for about 1 horizontal period.

The second switch TFT M3 is a switch element that switches the current holed flowing in the OLED in response to an EM signal EM from the EM line 16. The second switch TFT M3 maintains an off state during a scan period and is turned on or turned off in response to the EM signal EM which is turned on or turned off during a duty driving period so as to switch the current holed of the OLED. The duty driving method is implemented by regulating a time of turning on the OLED and a time of turning off the OLED depending on a duty ratio of the EM signal EM. The second switch TFT M3 includes a gate connected to the EM line, a source connected to the driving TFT M1, and a drain connected to the anode of the OLED. The EM signal EM is generated at an off level during a scan period and breaks the current holed of the OLED.

It is to be noted that a pixel circuit is not limited to FIG. 2. For example, in the pixel circuit, a switch element and a capacitor may be further provided for internal compensation and a sensing path may be further provided for external compensation. The sensing path includes one or more switch elements, a sample & holder, an analog-digital converter (ADC), etc. so as to sense a threshold voltage of a driving TFT or an OLED in a pixel and convert a sensing value into digital data and then transmit the digital data to the timing controller 110.

Figure 3:
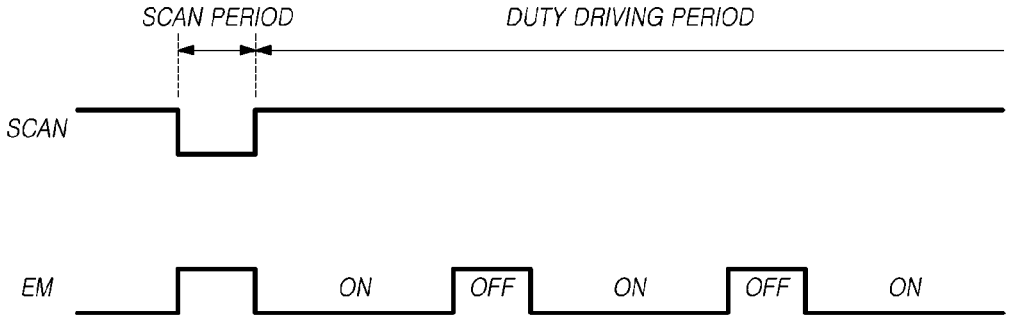
FIG. 3 is a waveform diagram of an EM signal according to the present exemplary aspect.

A 1 frame period of the organic light emitting display device is divided into a scan period and a duty driving period in which pixels are repeatedly turned on and off in response to the EM signal EM after the scan period, as illustrated in FIG. 3. The scan period is only about 1 horizontal period, and, thus, the most part of the 1 frame period is the duty driving period. In the present disclosure, during the scan period, a threshold voltage of the driving TFT may be sampled to compensate a current difference of the OLED by an internal compensation method known in the art and the data voltage DATA may be compensated as much as the threshold voltage.

According to the duty driving method for the EM signal, a pixel emits light with a high brightness such as a full white brightness and a gray scale is displayed by regulating an emission ratio of the EM signal controlled by a duty ratio of the EM signal. For example, if a full white brightness of a pixel is 500 nit, when the pixel is driven at a duty ratio of 20%, the user may recognize a brightness of 100 nit as the brightness of the pixel. Meanwhile, when the pixel is driven at a duty ratio of 80%, the user may recognize a brightness of 400 nit as the brightness of the pixel.

Also, according to the duty driving method, a stain (or Mura) of the display panel 100 can be improved. The Mura of the display panel 100 may be seen as a stain caused by emission of pixels with non-uniform brightness due to a process variation. According to a general method of driving a display panel, a gray scale is displayed by varying brightness of pixels depending on a gray scale of input data. The Mura may be seen darker or weaker depending on the brightness of the pixels. Therefore, according to the general driving method, in order to compensate for the Mura, a Mura compensation value needs to be changed depending on a gray scale value of the pixels. However, according to the duty driving method, pixels emit lights with the same high brightness and a gray scale is displayed by varying duty ratios for the pixels depending on a duty ratio of the EM signal EM. Therefore, if the pixels are driven according to the duty driving method, Mura is displayed with the same brightness at any gray scale and thus cannot be seen clearly. Thus, an algorithm for compensating for the Mura can be simplified.

Also, the duty driving method is advantageous for optical compensation of the display panel 100. The optical compensation may include color coordinate compensation, white balance compensation, etc. In general, the optical compensation is carried out with different compensation values depending on brightness of pixels. Therefore, according to the general driving method, compensation values for optical compensation need to be set depending on brightness of pixels, and, thus, the number of compensation values is increased and a compensation algorithm becomes complicated. However, according to the duty driving method, pixels emit lights with the same high brightness and a gray scale is displayed by varying duty ratios for the pixels depending on a duty ratio of the EM signal EM. Therefore, according to the duty driving method, the pixels are driven with the same brightness and the gray scale is displayed with the duty ratios for the pixels, and, thus, only an optical compensation value for a full white brightness is needed and an optical compensation algorithm can be simplified.

Further, the duty driving method can improve flickers which are regular flickers of a screen and a motion blur. The flickers can be seen well at a low driving frequency for the pixels. According to the duty driving method, a driving frequency for the pixels is increased by increasing duty ratios for the pixels, and, thus, flickers can be reduced. When the driving frequency for the pixels is increased, a response speed of the pixels is increased, and, thus, a motion blur in video can be improved.

Figure 4:
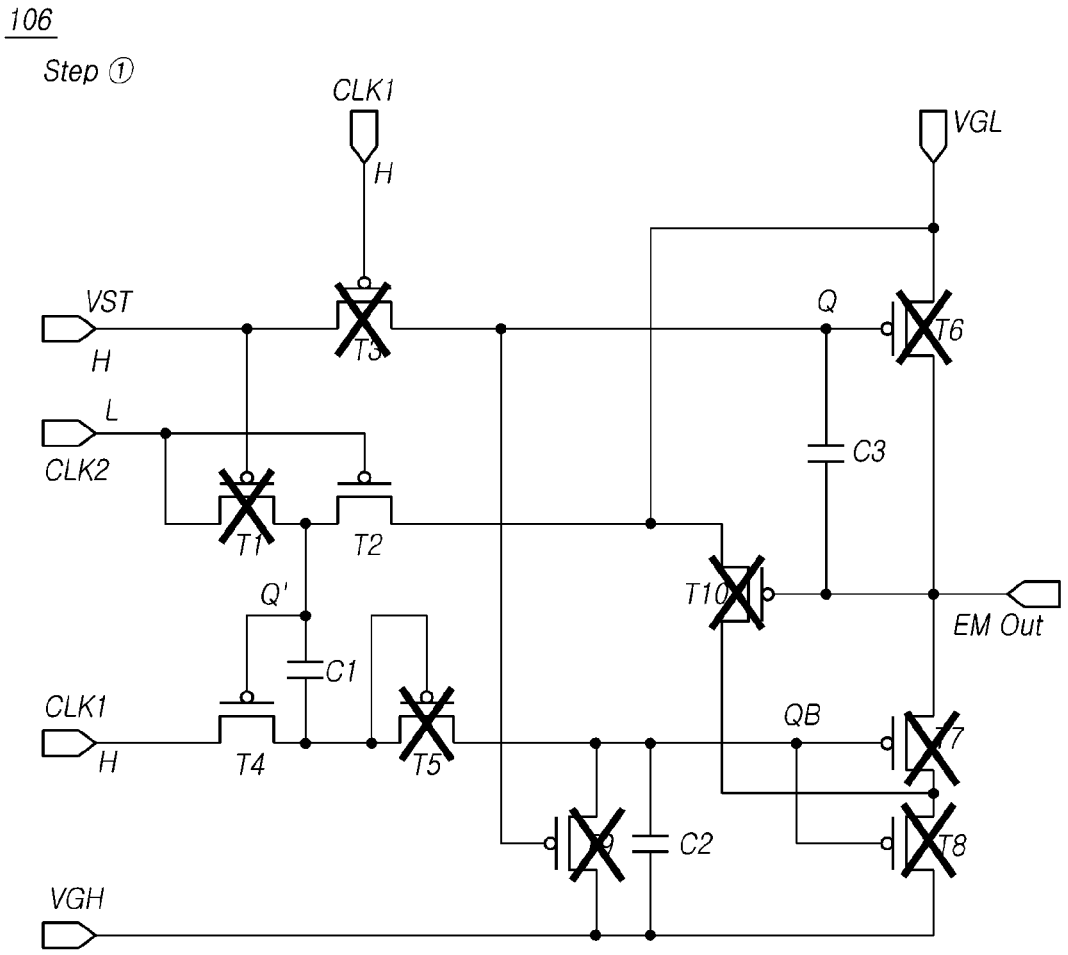
FIG. 4 through FIG. 9 are circuit diagrams and timing charts showing a circuit operation of an EM driver.
Figure 6:
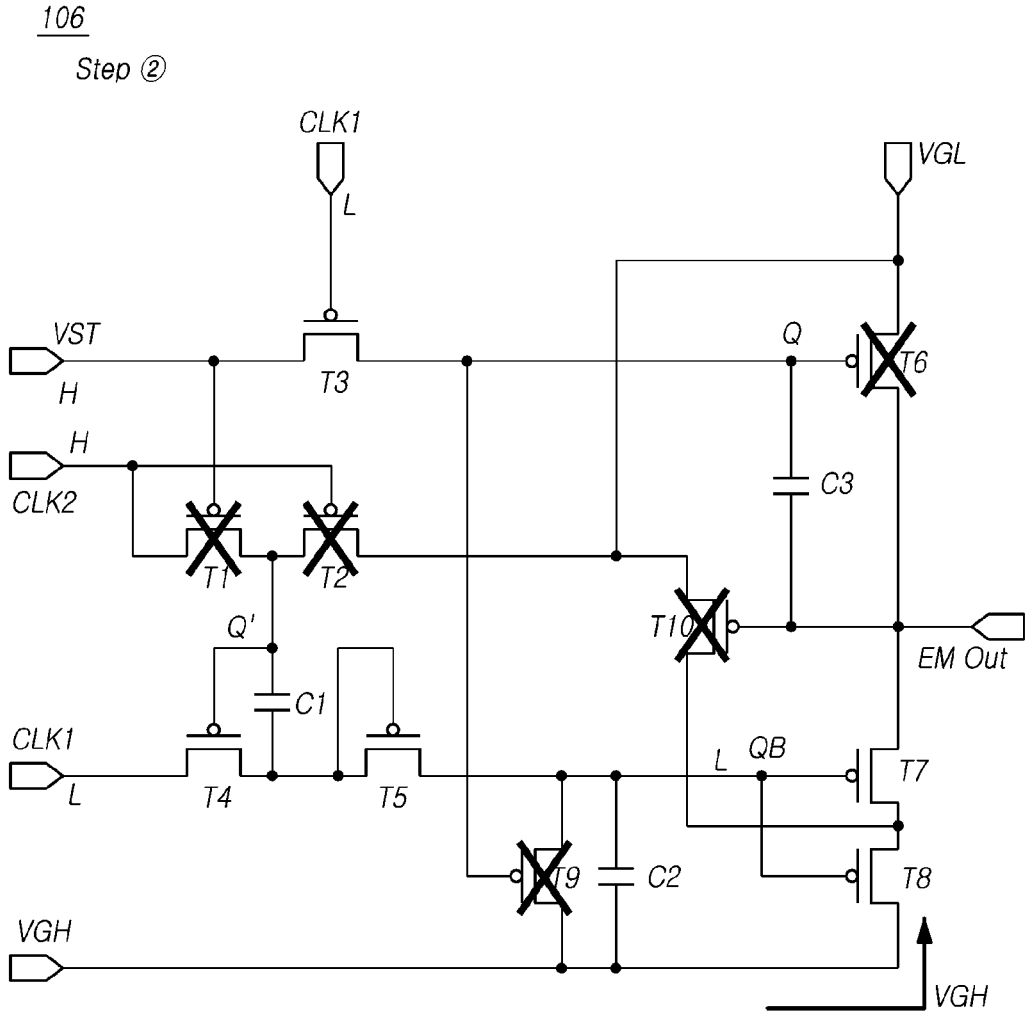
Figure 8:
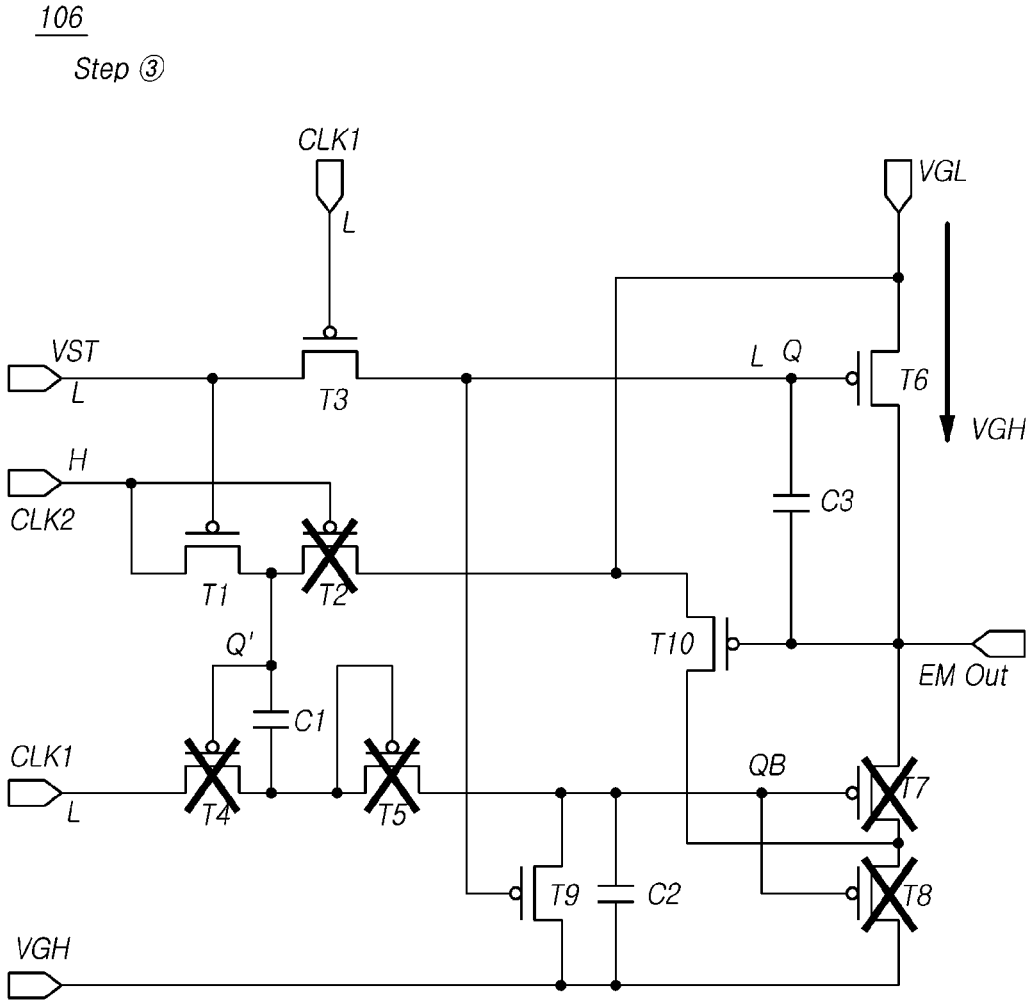

FIGS. 4, 6 and 8 are circuit diagrams of an EM driver according to the present exemplary aspect.

The EM driver 106 according to the present exemplary aspect includes a circuit configuration as shown in FIG. 4. Each EM driver 106 includes first to tenth transistors T1 to T10 and first to third capacitors C1 to C3. The TFTs T1 to T10 constituting each EM driver 106 are illustrated as p-type MOSFETs in FIG. 5, but are not limited thereto. For example, the TFTs T1 to T10 may be implemented as n-type MOSFETs. In this case, the phases of the start pulse VST and the shift clocks CLK1 and CLK2 may be inverted. The TFTs T1 to T10 may be implemented as any one of an amorphous silicon (a-Si) TFT, a polysilicon TFT, and an oxide semiconductor TFT or as a combination thereof. The TFTs T1 to T10 constituting stages ST1 to STn and transistors constituting the pixel circuit may be implemented as MOSFETs of the same type in order to simplify the manufacturing process.

The EM driver 106 is started when the start pulse VST becomes a high state, and the first and second clock signals CLK1 and CLK2 are started in a low state with a phase opposite to that of the start pulse VST. When the start pulse VST is turned on, the second clock signal CLK2 is synchronized with the start pulse VST and then generated with a phase opposite to that of the start pulse VST. Then, the first clock signal CLK1 is generated subsequent to the second clock signal CLK2 and started in a low state like the second clock signal CLK2. However, the first clock signal CLK1 and the second clock signal CLK2 are different by as much as one half cycle and thus have phases opposite to each other.

In the first transistor T1, a gate is connected to a start pulse supply terminal, a source is connected to a second clock terminal, and a drain is connected to the second transistor T2. Thus, the first transistor T1 is turned on or off in response to the start pulse VST. When the start pulse VST becomes a high state, the first transistor T1 is turned off, and when the start pulse VST becomes a low state, the first transistor T1 is turned on.

The second transistor T2 is connected in series to the first transistor T1. Since a gate of the second transistor T2 is connected to a second clock terminal, the second transistor T2 is turned on or off in response to the second clock signal CLK2. A source of the second transistor T2 is connected to the second clock terminal through the drain of the first transistor T1 and a drain is connected to a source of the tenth transistor T10. Therefore, when the second clock signal CLK2 is low, the second transistor T2 is turned on, and if the first transistor T1 is turned on when the start pulse VST is low, the second transistor T2 supplies the second clock signal CLK2 from the second clock terminal to the source of the tenth transistor T10.

Meanwhile, a line branched between the first transistor T1 and the second transistor T2 is connected to the first capacitor C1, and when the first transistor T1 or the second transistor T2 is turned on, the second clock signal CLK2 is stored in the first capacitor C1.

When the first clock signal CLK1 is supplied as a low signal to a QB node QB, a Q' node is floated and a voltage of the Q' node is increased by a parasitic capacitance. The first capacitor C1 suppresses a decrease in current of the fourth transistor T4 caused by the increase in voltage of the Q' node. If the current of the fourth transistor T4 is decreased, a voltage of the QB node QB is increased, which causes a decrease in current flowing in the seventh transistor T7 and the eighth transistor T8. Thus, a voltage of the EM signal EM does not become sufficiently high.

A gate of the third transistor T3 is connected to a first clock terminal, and, thus, the third transistor T3 is turned on and off in synchronization with the first clock signal CLK1. A source of the third transistor T3 is connected to the start pulse VST supply terminal and a drain is connected to a gate of the sixth transistor T6 connected to a low voltage supply terminal for the EM signal. Therefore, the sixth transistor T6 is turned on and off in synchronization with on and off of the third transistor T3. When the sixth transistor T6 is turned on, a low voltage from the low voltage supply terminal is supplied to an EM output terminal. Therefore, a low signal of the EM signal is output to the EM output terminal.

A gate of the fourth transistor T4 is connected to the line branched between the first transistor T1 and the second transistor T2 and the fourth transistor T4 is turned on and off in synchronization with on and off of the first transistor T1 and the second transistor T2. A source of the fourth transistor T4 is connected to the first clock terminal and a drain is connected to gates of the seventh and eighth transistors T7 and T8 through the fifth transistor T5. Therefore, when the fourth transistor T4 is turned on, the first clock signal CLK1 may be transferred to the gates of the seventh and eighth transistors T7 and T8 through the fifth transistor T5 so as to control on and off of the seventh and eighth transistors T7 and T8.

Both a gate and a source of the fifth transistor T5 are connected to the drain of the fourth transistor T4 and a drain is connected to the seventh and eighth transistors T7 and T8. Therefore, when the fourth transistor T4 is turned on, the first clock signal CLK1 is supplied to the fifth transistor T5 so as to control on and off of the fifth transistor T5. The fifth transistor T5 is turned on when the first clock signal CLK1 is low. Therefore, when the fifth transistor T5 is turned on, the first clock signal CLK1 in a low state is supplied to the seventh and eighth transistors T7 and T8. Therefore, when the fifth transistor T5 is turned on, the first clock signal CLK1 in a low state is supplied to the QB node. Thus, the seventh and eighth transistors T7 and T8 are also turned on.

The seventh and eighth transistors T7 and T8 are connected in series to each other. Both the gates of the seventh and eighth transistors T7 and T8 are connected to the drain of the fifth transistor T5. Both the seventh and eighth transistors T7 and T8 are connected to a high voltage supply terminal that supplies a high level voltage of the EM signal, and when the seventh and eighth transistors T7 and T8 are turned on, a high voltage VGH is output as the EM signal from the high voltage supply terminal through the EM output terminal. Since the seventh and eighth transistors T7 and T8 are disposed in series, the output of the high voltage VGH can be switched more stably.

A source and a drain of the ninth transistor T9 are disposed to be connected to the drain of the fifth transistor T5 and the high voltage supply terminal, respectively. A gate of the ninth transistor T9 is connected between the third transistor T3 and the sixth transistor T6, and, thus, when the third transistor T3 is turned on, the ninth transistor T9 is turned on and off by the start pulse VST.

The second capacitor C2 is connected in parallel to the ninth transistor T9, and when the seventh and eighth transistors T7 and T8 are turned on, the second capacitor C2 stores a difference between a level of the first clock signal CLK1 and the high voltage VGH.

A gate of the tenth transistor T10 is connected to the EM output terminal, and when the EM signal is low, the tenth transistor T10 is turned on. One end of the source and a drain of the tenth transistor T10 is connected to the second transistor T2 and the low voltage supply terminal and the other end of the source and the drain is connected between the seventh transistor T7 and the eighth transistor T8.

The third capacitor C3 is provided on a line that connects the gate of the sixth transistor T6 and the gate of the tenth transistor T10, and when the sixth transistor T6 is turned on, the third capacitor C3 is charged with a current flowing in the sixth transistor T6. When a low voltage VGL is output to the EM output terminal, a Q node is floated and a voltage of the Q node is increased by a parasitic capacitance. The third capacitor C3 suppresses a decrease in current of the sixth transistor T6 caused by the increase in voltage of the Q node.

Figure 5:
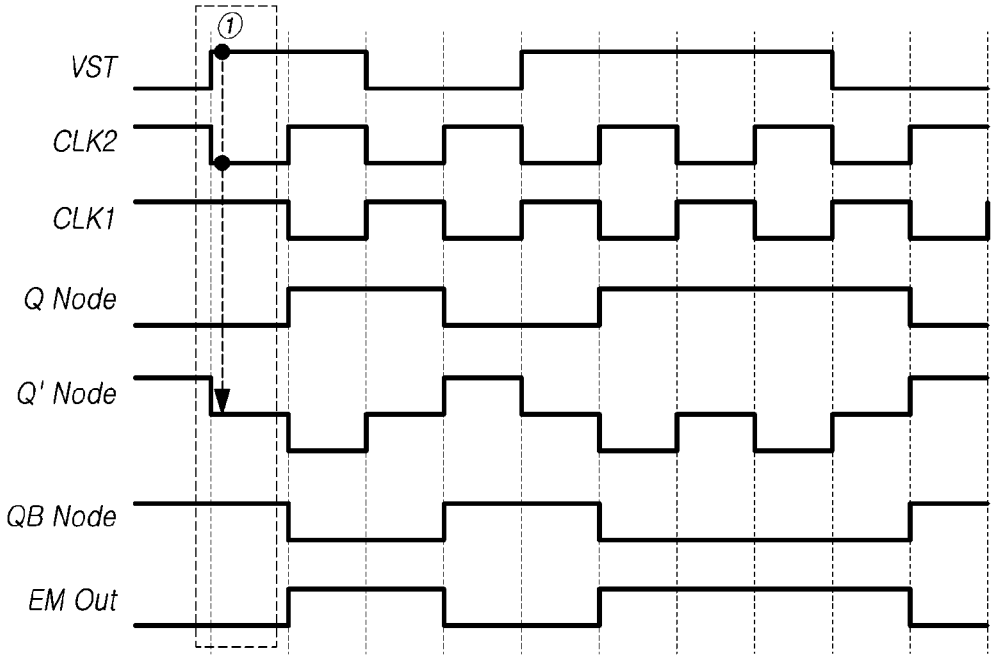

The EM driver 106 of the present disclosure implements the duty driving method for pixels without a need for a shift register and an inverter. The EM driver 106 can regulate a duty ratio of the EM signal EM by regulating the start pulse VST as shown in FIG. 5. A cycle, a pulse width, and a duty ratio of the EM signal EM can be controlled in the same manner as those of the start pulse VST.

FIG. 4 through FIG. 9 are circuit diagrams and timing charts showing a circuit operation of an EM driver.

Referring to FIG. 5 and FIG. 6, in a step $\hat{1}$, the start pulse VST generates a high signal and the second clock terminal generates a low signal at the same time. At this point of time, the first clock terminal maintains a high state. Thus, the second transistor T2 is turned on by the second clock signal CLK2 and the low signal is supplied to the Q' node. At this point of time, the Q' node is in a low state, and, thus, the fourth transistor T4 is turned on and the first capacitor C1 is charged.

Figure 7:
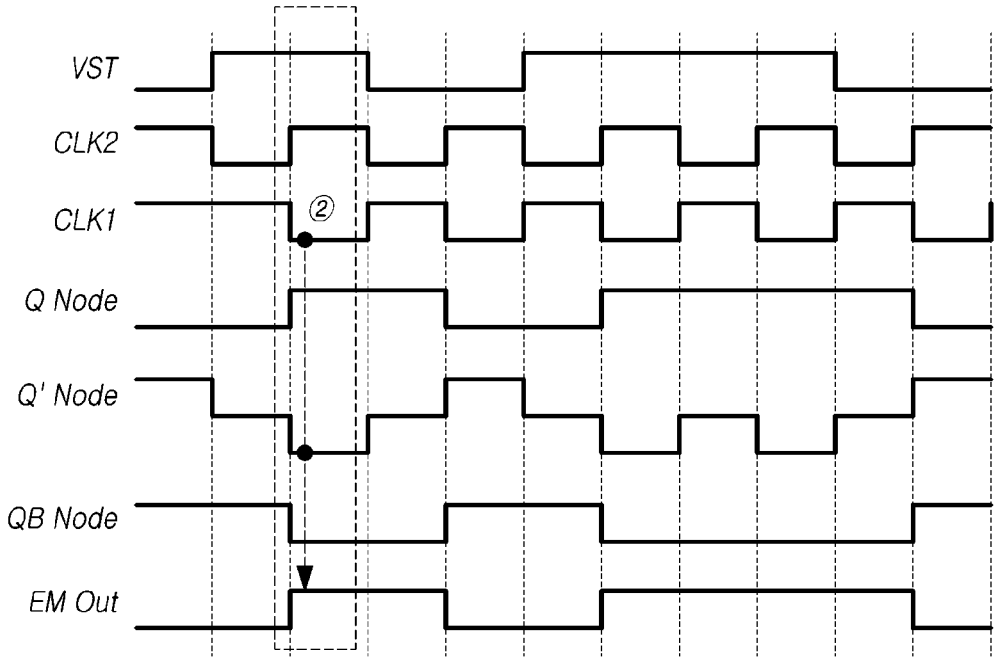

Referring to FIG. 7 and FIG. 8, in a step $\hat{2}$, the start pulse VST maintains a high state, the first clock terminal generates a low signal, and the second clock terminal generates a high signal. Therefore, the first clock signal CLK1 is in a low state, and, thus, the third transistor T3 is turned on and the start pulse VST in a high state is supplied to the Q node through the third transistor T3. Thus, the sixth transistor T6 maintains a turn-off state.

Meanwhile, the fourth transistor T4 is turned on when the first capacitor C1 is charged with a low signal and supplies the first clock signal CLK1 in a low state to the fifth transistor T5. The fifth transistor T5 is turned on by the first clock signal CLK1 in a low state and supplies the first clock signal CLK1 in a low state to the QB node. Then, the seventh transistor T7 and the eighth transistor T8 are turned on, and a high level voltage is output from the high voltage VGH supply terminal to the EM output terminal through the seventh transistor T7 and the eighth transistor T8.

At this point of time, the ninth transistor T9 is turned on by the first clock signal CLK1 in a low state, and the second capacitor C2 stores a voltage equivalent to a difference between the high voltage VGH and a low voltage of the first clock signal CLK1.

Figure 9:
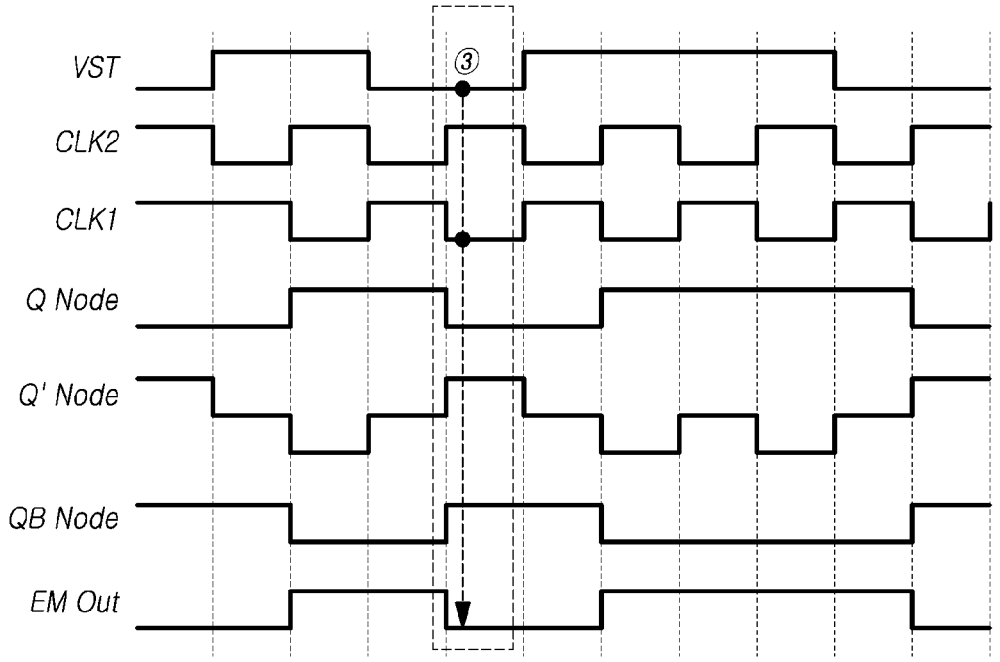
Figure 10:
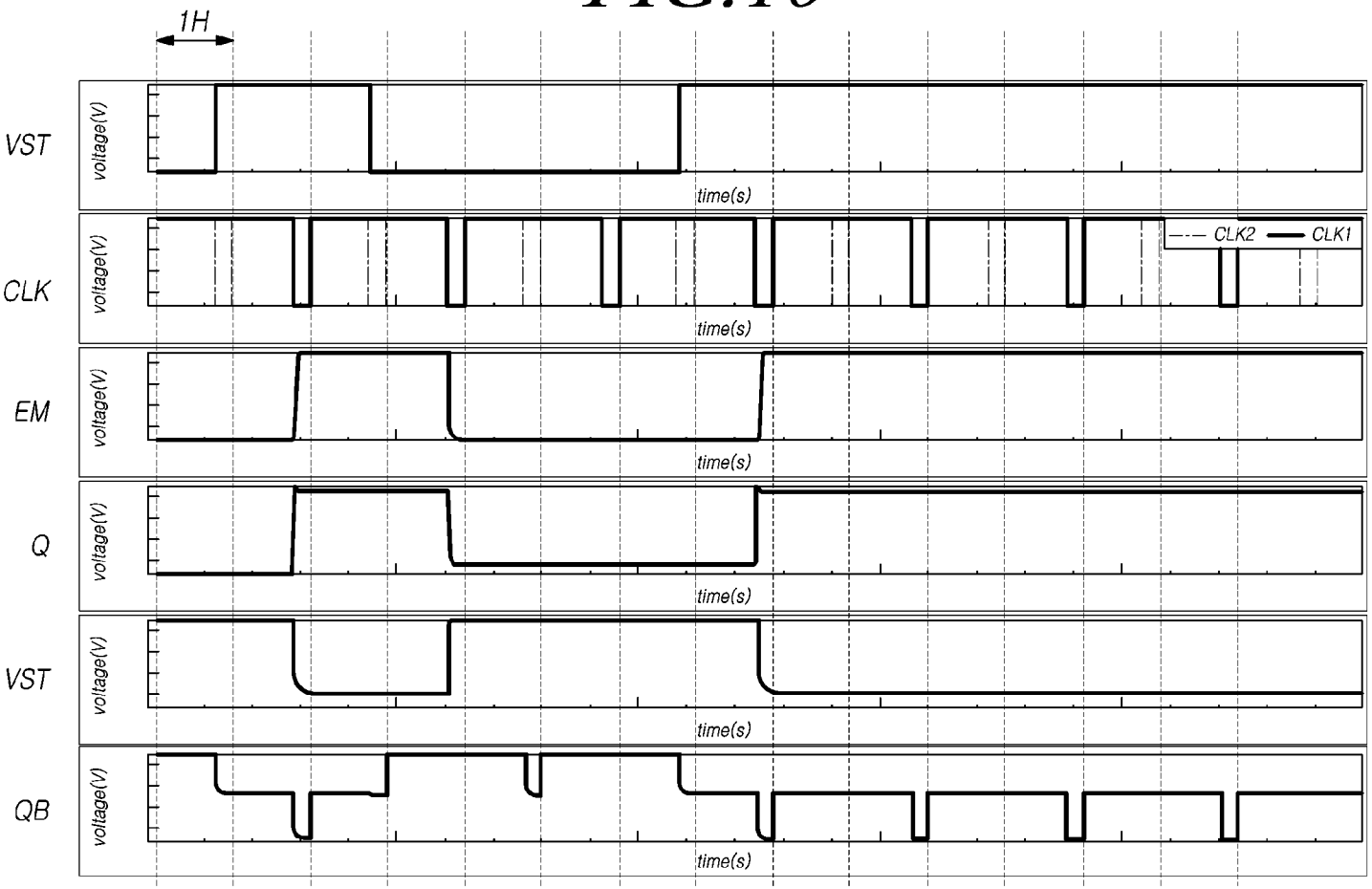
FIG. 10 is a timing chart showing a simulation result of an EM driver according to the present exemplary aspect.

Referring to FIG. 9 and FIG. 10, in a step $\hat{3}$, the start pulse VST maintains a low state, the first clock signal CLK1 becomes a low state, and the second clock signal CLK2 becomes a high state. Then, the third transistor T3 is turned on by the first clock signal CLK1 and transfers the start pulse VST in a low state to the Q node. Therefore, the Q node becomes a low state, and, thus, the sixth transistor T6 is turned on and a low voltage VGL is output from the low voltage VGL supply terminal to the EM output terminal through the sixth transistor T6.

At this point of time, the EM output terminal becomes a low state, and, thus, the tenth transistor T10 is turned on. Therefore, the low voltage VGL from the low voltage VGL supply terminal is stored in the third capacitor C3 and then stably output through the sixth transistor T6.

Meanwhile, the first transistor T1 is turned on by the start pulse VST and allows a high signal from the second clock terminal to pass through. Thus, the high signal is applied to the Q' node. Therefore, the fourth transistor T4 is turned off and the high signal is supplied to the gate of the fifth transistor T5, and, thus, the fifth transistor T5 is also turned off. The ninth transistor T9 is turned on by a low signal from the first clock terminal and voltages of the both ends of the ninth transistor T9 become identical to the high voltage VGH supplied from the high voltage VGH supply terminal. Thus, the second capacitor C2 becomes initialized.

FIG. 10 is a timing chart showing a simulation result of an EM driver according to the present exemplary aspect.

As illustrated in FIG. 10, a cycle T, a pulse width, and a duty ratio of the EM signal EM are regulated by the start pulse VST. The start pulse VST rises or falls in synchronization with the second clock signal CLK2. The first clock signal CLK1 is turned on and off with a difference of one half cycle from the second clock signal CLK2.

When the start pulse VST is generated in synchronization with the second clock signal CLK2, a voltage of the Q node Q rises to the high voltage VGH in synchronization with the following first clock signal CLK1 and a voltage of the QB node falls to the low voltage VGL. In synchronization with this, the EM signal EM rises to the high voltage VGH.

When the start pulse VST falls in synchronization with the second clock signal CLK2, the voltage of the Q node Q falls to the low voltage VGL in synchronization with the following first clock signal CLK1 and the voltage of the QB node rises to the high voltage VGH. In synchronization with this, the EM signal EM falls to the low voltage VGL.

Accordingly, when a pulse width W of the start pulse VST is increased, the pulse width of the EM signal EM is also increased, and, thus, a duty ratio of the pixel is changed.

Meanwhile, whenever the start pulse VST is input during an emission period, the EM signal EM forms a pulse, and when the EM signal rises to the high voltage VGH, the pixels are turned off. In this case, as a gray scale of an input image is decreased, the number of times and a time of turning on the pixels are increased. Therefore, the number of start pulses VST generated during the emission period is increased as a gray scale of input image data is decreased. Also, the pulse width W of the start pulse VST generated during the emission period may be controlled to be increased as a gray scale of input image data is decreased.

As described above, the present disclosure discloses a circuit capable of regulating the cycle T, the pulse width, and the duty ratio of the EM signal using the EM driver only. Therefore, a pair of inverters and a pair of shift registers which need to be included in the prior art are unified into a single circuit, and, thus, a circuit can be simplified. Accordingly, the size of the bezel area where the EM driver is disposed can be reduced and the implementation of circuit can be facilitated.

Meanwhile, since a duty ratio can be regulated by the EM driver, it becomes easy to regulate a gray scale and it is possible to improve Mura of a display panel. Also, it is advantageous for optical compensation and possible to improve flickers and a motion blur.

The features, structures, effects, etc. described in the above exemplary aspects are included in at least one exemplary aspect and but are not limited to one exemplary aspect. In addition, the features, structures, effects, etc. described in the respective exemplary aspects may be executed by those skilled in the art while being combined or modified with respect to other aspects. Accordingly, it will be understood that contents related the combination and modification will be included in the scope of the present disclosure.

Further, it will be understood that the exemplary aspects described above should be considered in a descriptive sense only and not for purposes of limitation. It will be understood by those skilled in the art that various other modifications and applications may be made therein without departing from the spirit and scope of the exemplary aspects. For example, respective components shown in detail in the exemplary aspects may be executed while being modified. Also, it should be construed that differences related to the modification and application are included in the scope of the present disclosure as defined by the following claims.

What is claimed is:

1. An organic light emitting display device, comprising:

a display panel in which pixels are disposed in a matrix form;

a data driver that supplies a data voltage to the display panel;

a scan driver that supplies a scan signal to the display panel and synchronized with the data voltage;

a timing controller that generates a timing control signal for controlling an operation timing of the data driver and an operation timing of the scan driver; and a duty driver that generates an EM signal for controlling on and off of pixels in response to the timing control signal including a shift clock and operates the EM signal at a high voltage level in response to a high signal of a start pulse for controlling an output generation and operates the EM signal at a low voltage level in response to a low signal of the start pulse to regulate a cycle and a width of the EM signal, wherein the shift clock includes a first signal clock CLK1 and a second signal clock CLK2 that have a same pulse width and an opposite phase with each other, and the first signal clock CLK1 is turned on and off with a difference of one half cycle from the second signal clock CLK2 throughout an operation timing of the duty driver.

2. The organic light emitting display device according to claim 1, wherein the duty driver comprises:

a first TFT including a gate connected to a start pulse supply terminal to which a start pulse is input, a source connected to a second clock terminal to which a second clock signal is input, and a drain connected to an output terminal for the EM signal;

a second TFT including a gate connected to the second clock terminal, a source connected to the drain of the first TFT, and a drain connected to the output terminal for the EM signal;

a third TFT including a gate connected to a first clock terminal to which a first clock signal is input, a drain connected to the start pulse supply terminal, and a source connected to a Q node;

a fourth TFT including a gate connected between the first TFT and the second TFT, a source connected to the first clock terminal, and a drain connected to a QB node;

a fifth TFT including a source and a gate connected between the drain of the fourth TFT and the QB node and connected to the first clock terminal and a drain connected to the QB node;

a sixth TFT including a gate connected to the drain of the third TFT, a source connected to a low voltage terminal that outputs a low level voltage of the EM signal, and a drain connected to the output terminal for the EM signal and configured to control an output of a low voltage from the low voltage terminal; and a seventh TFT including a gate connected to the QB node, a source connected to a high voltage terminal that outputs a high level voltage of the EM signal, and a drain connected to the output terminal for the EM signal and configured to control an output of a high voltage from the high voltage terminal.

3. The organic light emitting display device according to claim 2, wherein the duty driver comprises:

an eighth TFT including a source connected to the high voltage terminal, a drain connected to the seventh TFT, and a gate connected to the QB node.

4. The organic light emitting display device according to claim 3, wherein the duty driver further comprises:

a ninth TFT including a gate connected to the drain of the third TFT and a source and a drain connected to the high voltage terminal and the drain of the fifth TFT, respectively; and a second capacitor connected between the high voltage terminal and the drain of the fifth TFT and connected in parallel to the ninth TFT.

5. The organic light emitting display device according to claim 4, wherein the duty driver further comprises:

a tenth TFT including a gate connected to the output terminal for the EM signal, a source or drain connected to the drain of the second TFT, and a drain or source connected between the seventh TFT and the eighth TFT; and a first capacitor provided on a line that connects the Q node and the gate of the tenth TFT.

6. The organic light emitting display device according to claim 5, wherein the duty driver further comprises:

a second capacitor provided on a line that connects the gate and the drain of the fourth TFT.

7. The organic light emitting display device according to claim 1, wherein the duty driver regulates a duty ratio of the EM signal by regulating the start pulse.

8. The organic light emitting display device according to claim 1, wherein the start pulse inverts the EM signal by being toggled at least once within an emission period during every frame period.

9. The organic light emitting display device according to claim 1, wherein the duty driver comprises a shift register sequentially generating scan signals and an inverter inverting an output of the shift register.

10. The organic light emitting display device according to claim 1, wherein the duty driver is formed on a substrate of the display panel when a pixel array of the display panel is formed by a gate driver in panel process.

11. The organic light emitting display device according to claim 1, wherein the duty driver receives the start pulse of an off-level voltage and the shift clock of an on-level voltage and outputs the EM signal and shifts the EM signal EM at a shift clock timing.

12. The organic light emitting display device according to claim 1, wherein the duty driver operates the EM signal at an off level when the start pulse is input, and the width of the EM signal is determined by a width of the start pulse.

13. A device for driving an organic light emitting display device including pixels which are turned on and off during a duty driving period in response to an EM signal, the device comprising:

a duty driver that receives a shift clock and generates the EM signal for controlling an operation of the pixels, and operates the EM signal at a high voltage level in response to a high signal of a start pulse for controlling an output generation and operates the EM signal at a low voltage level in response to a low signal of the start pulse to regulate a cycle and a width of the EM signal, wherein the shift clock includes a first signal clock CLK1 and a second signal clock CLK2 that have a same pulse width and an opposite phase with each other, and the first signal clock CLK1 is turned on and off with a difference of one half cycle from the second signal clock CLK2 throughout an operation timing of the duty driver.

14. The device for driving an organic light emitting display device according to claim 13, wherein the duty driver comprises:

a first TFT including a gate connected to a start pulse supply terminal to which a start pulse is input, a source connected to a second clock terminal to which a second clock signal is input, and a drain connected to an output terminal for the EM signal;

a second TFT including a gate connected to the second clock terminal, a source connected to the drain of the first TFT, and a drain connected to the output terminal for the EM signal;

a third TFT including a gate connected to a first clock terminal to which a first clock signal is input, a drain connected to the start pulse supply terminal, and a source connected to a Q node;

a fourth TFT including a gate connected between the first TFT and the second TFT, a source connected to the first clock terminal, and a drain connected to a QB node;

a fifth TFT including a source and a gate connected between the drain of the fourth TFT and the QB node and connected to the first clock terminal and a drain connected to the QB node;

a sixth TFT including a gate connected to the drain of the third TFT, a source connected to a low voltage terminal that outputs a low level voltage of the EM signal, and a drain connected to the output terminal for the EM signal and configured to control an output of a low voltage from the low voltage terminal; and a seventh TFT including a gate connected to the QB node, a source connected to a high voltage terminal that outputs a high level voltage of the EM signal, and a drain connected to the output terminal for the EM signal and configured to control an output of a high voltage from the high voltage terminal.

15. The device for driving an organic light emitting display device according to claim 14, wherein the duty driver further comprises:

an eighth TFT including a source connected to the high voltage terminal, a drain connected to the seventh TFT, and a gate connected to the QB node.

16. The device for driving an organic light emitting display device according to claim 14, wherein the duty driver further comprises:

a ninth TFT including a gate connected to the drain of the third TFT and a source and a drain connected to the high voltage terminal and the drain of the fifth TFT, respectively; and a second capacitor connected between the high voltage terminal and the drain of the fifth TFT and connected in parallel to the ninth TFT.

17. The device for driving an organic light emitting display device according to claim 14, wherein the duty driver further comprises:

a tenth TFT including a gate connected to the output terminal for the EM signal, a source or drain connected to the drain of the second TFT, and a drain or source connected between the seventh TFT and the eighth TFT; and a third capacitor provided on a line that connects the Q node and the gate of the tenth TFT.

18. The device for driving an organic light emitting display device according to claim 14, wherein the duty driver further comprises a first capacitor provided on a line that connects the gate and the drain of the fourth TFT.

19. An apparatus for driving an organic light emitting display device comprising a plurality of pixels operating during a duty driving period in response to an EM signal, the apparatus comprising:

a duty driver receiving a start pulse of an off-level voltage and a shift clock of an on-level voltage, and outputting the EM signal and shifting the EM signal at a shift clock timing in operating the plurality of pixels, wherein the duty driver operates the EM signal at an off level when the start pulse is input, and a width of the EM signal is determined by a width of the start pulse, wherein the shift clock includes a first signal clock CLK1 and a second signal clock CLK2 that have a same pulse width and an opposite phase with each other, and the first signal clock CLK1 is turned on and off with a difference of one half cycle from the second signal clock CLK2 throughout an operation timing of the duty driver.

20. The apparatus according to claim 19, wherein the duty driver regulates a duty ratio of the EM signal by regulating the start pulse.

21. The apparatus according to claim 19, wherein the start pulse inverts the EM signal by being toggled at least once within an emission period during every frame period.

22. The apparatus according to claim 19, wherein the duty driver comprises a shift register sequentially generating scan signals and an inverter inverting an output of the shift register.

23. The apparatus according to claim 19, wherein the duty driver is formed on a substrate of the display panel when a pixel array of the display panel is formed by a gate driver in panel process.

* * * * *